US011597590B2

(12) United States Patent
Austrheim

(10) Patent No.: US 11,597,590 B2
(45) Date of Patent: Mar. 7, 2023

(54) CONTAINER ARRANGEMENT AND METHOD

(71) Applicant: Autostore Technology AS, Nedre Vats (NO)

(72) Inventor: Trond Austrheim, Etne (NO)

(73) Assignee: Autostore Technology AS, Nedre Vats (NO)

( * ) Notice: Subject to any disclaimer, the term of this patent is extended or adjusted under 35 U.S.C. 154(b) by 0 days.

(21) Appl. No.: 17/280,917

(22) PCT Filed: Sep. 23, 2019

(86) PCT No.: PCT/EP2019/075460
§ 371 (c)(1),
(2) Date: Mar. 29, 2021

(87) PCT Pub. No.: WO2020/074243
PCT Pub. Date: Apr. 16, 2020

(65) Prior Publication Data

US 2021/0339943 A1 Nov. 4, 2021

(30) Foreign Application Priority Data

Oct. 12, 2018 (NO) ..... 20181310

(51) Int. Cl.
*B65D 90/00* (2006.01)
*B65D 21/02* (2006.01)
(Continued)

(52) U.S. Cl.
CPC ..... *B65D 90/0006* (2013.01); *B65D 21/0201* (2013.01); *B65D 88/027* (2013.01);
(Continued)

(58) Field of Classification Search
CPC ..... B65D 90/0006; B65D 21/0201; B65D 88/027; B65D 88/121; B65D 88/127;
(Continued)

(56) References Cited

U.S. PATENT DOCUMENTS 3,052,941 A * 9/1962 Abolins ..... B65D 90/0013 254/102
3,691,595 A * 9/1972 Backteman ..... B65D 90/0013 24/DIG. 54
(Continued)

FOREIGN PATENT DOCUMENTS

CN 87102300 A 1/1988
CN 106794937 A 5/2017
(Continued)

OTHER PUBLICATIONS

Office Action issued in Chinese Application No. 2019800645642 dated Mar. 23, 2022 (10 pages).
(Continued)

*Primary Examiner* — Kareen K Thomas
(74) *Attorney, Agent, or Firm* — Osha Bergman Watanabe & Burton LLP

(57) ABSTRACT

The invention relates to a container arrangement comprising a plurality of connected containers, each for storing an automated storage and retrieval system. A coupling arrangement connects and aligns connected containers side-by-side. The containers may be intermodal containers. The invention also relates to a method for providing such an arrangement.

12 Claims, 9 Drawing Sheets

(51) Int. Cl.
*B65D 88/02* (2006.01)
*B65D 88/12* (2006.01)

(52) U.S. Cl.
CPC ..... *B65D 88/121* (2013.01); *B65D 88/127* (2013.01); *B65D 90/0073* (2013.01); *B65D 2588/12* (2013.01); *B65D 2590/0008* (2013.01); *B65D 2590/0041* (2013.01)

(58) Field of Classification Search
CPC ..... B65D 90/0073; B65D 2588/12; B65D 2590/0008; B65D 2590/0041; B65D 88/022; B65D 88/12; B65G 1/04
See application file for complete search history.

(56) References Cited

U.S. PATENT DOCUMENTS 3,938,461 A * 2/1976 Marriner ..... B63B 35/70 114/249
4,208,979 A * 6/1980 Mack ..... E02B 3/064 405/196
4,599,829 A 7/1986 DiMartino
4,610,215 A 9/1986 Robishaw et al.
4,729,707 A 3/1988 Takahashi
4,856,150 A * 8/1989 Johnson ..... B65D 90/0013 410/83
4,950,114 A * 8/1990 Borchardt ..... B65D 88/022 410/82
6,363,586 B1 4/2002 Neufingerl
2013/0068638 A1 3/2013 Ho
2016/0145040 A1 5/2016 Bowser

FOREIGN PATENT DOCUMENTS

DE 102014002497 8/2014
EP 1167235 1/2002
EP 3205603 8/2017
NO 317366 B1 10/2004
WO 87/04994 8/1987
WO 2007/033498 3/2007
WO 2011/094835 A1 8/2011
WO 2014/090684 A1 6/2014
WO 2016/055684 A1 10/2014
WO 2015/104263 A2 7/2015
WO 2016/166294 10/2016

OTHER PUBLICATIONS

ISR dsted Nov. 29, 2019.
WOIPEA dated Aug. 25, 2020.
IPER dated Feb. 3, 2021.

* cited by examiner

CONTAINER ARRANGEMENT AND METHOD

TECHNICAL FIELD

The present invention relates to a container arrangement comprising a plurality of mobile containers aligned together with high precision.

BACKGROUND AND PRIOR ART

A mobile container such as an intermodal container or shipping container is a container for storage of goods that can be transported by e.g. train, ship, plane and truck and further which can be used across these different means of transport.

Intermodal containers are used worldwide to store and transport goods efficiently and securely around the world. They are often referred to by different names, such as cargo container, ISO container and shipping container.

Intermodal containers occur in many different standardized sizes and are often made of steel or aluminum. The dimensions of an intermodal container may vary from 2.4 to 17.1 m in length, from 2.2 to 2.5 m in width and from 2.2 to 2.9 m in height.

Table 1 shows examples of dimensions and net loads of some of the most common standardized types of intermodal containers.

TABLE 1

Dimensions and net loads of intermodal containers.

| | | 20' container | 40' container | 45' high-cube containers |
|---|---|---|---|---|
| External dimensions | length | ~6.1 m | ~12.2 m | ~13.7 m |
| | width | ~2.4 m | ~2.4 m | ~2.4 m |
| | height | ~2.6 m | ~2.6 m | ~2.9 m |
| Interior dimensions | length | ~5.9 m | ~12.0 m | ~13.6 m |
| | width | ~2.4 m | ~2.4 m | ~2.4 m |
| | height | ~2.4 m | ~2.4 m | ~2.7 m |
| Door opening | width | ~2.3 m | ~2.3 m | ~2.3 m |
| | height | ~2.3 m | ~2.3 m | ~2.6 m |
| Internal volume | | ~33.1 $m^3$ | ~67.5 $m^3$ | ~86.1 $m^3$ |
| Net load | | ~28,200 kg | ~26,200 kg | ~25,600 kg |

The intermodal containers can bundle cargo and goods into larger, unitized loads, that can be easily handled, moved, and stacked, and that will pack tightly in a ship or yard. Intermodal containers share a number of construction features to withstand the stresses of intermodal shipping, to facilitate their handling and to allow stacking. Further, they may be identifiable through individual unique ISO 6346 reporting marks.

Different connection means or devices are known from the prior art to connect intermodal containers. WO 2011/094835 A1 discloses a fastening assembly attached to the outer surface of the containers to be connected allowing the containers to be easily disconnected from each by a user, since no screws are used in the fastening assembly. The fastening assembly comprises bosses welded to the containers to be connected for fastening a plate thereto and locking the plate to the bosses using, for example, an L-bolt.

However, none of the prior art documents aim to connect intermodal containers in a side-by-side arrangement that facilitates high precision alignment of the containers relative to one another.

An object of the present invention is to provide a container arrangement comprising a plurality of containers (such as intermodal containers) connected in a side-by-side arrangement which facilitates high precision alignment of the containers relative to one another.

A second object is to provide a method for connecting a plurality of containers.

SUMMARY OF THE INVENTION

The present invention is set forth and characterized in the independent claims, while the dependent claims describe other optional or preferred features of the invention.

The present invention relates to a container arrangement having at least two containers connected in a side-by-side arrangement with high precision alignment.

Such high precision can for example be important when the container arrangement comprises containers having an automated storage and retrieval system situated inside for the purpose of connecting these automated storage and retrieval systems.

A detailed description of a prior art automated storage and retrieval system is presented in inter alia WO 2014/090684 A1 and WO 2015/104263 A1. The automated storage and retrieval systems comprise a grid structure for storing storage bins in stacks. The storage grid is normally constructed as columns interconnected by top rails providing a rail system onto which remotely operated vehicles or robots, are arranged to move horizontally. The bins are stacked on top of each other up to a certain height and the vehicles are configured to pick up and store storage bins within the three-dimensional storage grid. Details of a prior art vehicle relevant for use in such an automated storage and retrieval system are disclosed in Norwegian patent NO317366.

The rail system providing the running surface of the vehicles should have a low degree of roughness and should not have discontinuities in the rails, to avoid any kind of disruption in the movement of the vehicles which may cause them to lose speed, stop or to jump of the rail. The roughness/discontinuities result from, inter alia, imperfections in the dimensions or directions of the rail systems. To allow smooth running, such roughness/discontinuities should be of a size less than 0.1 mm. Accordingly, when two such rail systems are to be connected, the rail systems must be aligned with high precision when connected. Two rail systems might be connected when each is provided in a separate mobile container, and then the mobile containers are connected. In such a case, connecting sides of the containers must have corresponding openings allowing the connection of the rail systems between the containers.

Further, the mentioned automated storage and retrieval systems are not easy to move after being placed inside the container since they comprise a plurality of storage bins comprising items. It is therefore necessary that the connection of the containers provide the high precision alignment.

A first embodiment of the present invention relates to a container arrangement having a first container for storing a first automated storage and retrieval system and a second container for storing a second automated storage and retrieval system. The first container comprises a first container frame defining a first connection face and the second container comprises a second container frame defining a second connection face. The container arrangement further comprises a coupling arrangement for connecting and aligning the first and second container side-by-side, with the first connection face of the first container aligned with the second connection face of the second container. At least a portion of the first container frame at the first connection face and at least a portion of the second container frame at the second connection face comprise connection features configured to interface with the coupling arrangement to connect and align the first and second containers.

The coupling arrangement may further be configured to releasably connect the first and the second containers, such that the first and second containers can be separated from each other when needed.

A skilled person will understand the coupling arrangement may also be used for connecting the connection faces of stacked containers.

The first and second container frame may have a substantially rectangular cuboid shape.

The first container frame may comprise a first base panel/floor, a first top panel/roof and a first plurality of vertically extending profiles (for example, four vertically extending profiles) extending between the first base panel/floor and first top panel/roof.

Similarly, the second container frame may comprise a second base panel/floor, a second top panel/roof and a second plurality of vertically extending profiles (for example, four vertically extending profiles) extending between the second base panel/floor and second top panel/roof.

The connection features may be located along the first base panel at a first connection face (vertical extent) of the first base panel, and along the second base panel at a second connection face (vertical extent) of the second base panel. Alternatively or additionally, the connection features may be located along the first top panel at the first connection face and along the second top panel at the second connection face. Alternatively or additionally, the connection features may be located along two of the first plurality of vertically extending profiles at the first connection face, and along two of the second plurality of vertically extending profiles at the second connection face.

In a preferred embodiment the first container comprises at least two holes arranged along the first base panel at the first connection face facing at least two corresponding holes arranged on second connection face of the second base panel of the second container.

In a more preferred embodiment the first container comprises at least four holes arranged along the first base panel at the first connection face facing at least four corresponding holes arranged on second connection face of the second base panel of the second container.

In a preferred embodiment the holes are evenly distributed along the connection faces.

In a preferred embodiment the holes are evenly distributed along a connection face such that no holes are arranged at corners of the connection face.

In a further embodiment the connection features are holes, and the coupling arrangement comprises a connecting pin (or a plurality of connecting pins), where the connecting pin is received within the holes to form a tight-fit friction connection.

The holes may have a funnel shape and the connecting pin can be configured to match at least the smallest diameter of the funnel shaped holes creating a tight fit friction connection.

One example of a "funnel shaped" hole is a smoothly tapering hole, narrowing from a largest cross-section at the entrance to the hole, to a smallest cross-section at the other end of the hole. The hole may have a circular cross-section along its length.

Thus, the "funnel shaped" hole may be a conical (or frustoconical) shaped hole.

Alternatively, the "funnel shaped" hole may comprise a broadly cylindrical outer portion (closest to the entrance to the hole) and a frustoconical inner portion (furthest from the entrance to the hole). Then, the cross section of the hole is initially constant for the outer portion, before narrowing along the inner portion.

The hole may therefore be conical/frustoconical, partially conical/frustoconical, or otherwise tapered.

In other embodiments, the hole is not tapered, but is broadly cylindrical.

In a further embodiment the connecting pin has a smaller cross-section at its ends than at its midpoint, such that the cross-section of the connecting pin expands from the ends towards the midpoint of the connecting pin.

The diameter of the cross-section at the midpoint may be at least 1.05 times greater than the diameter of the cross-section at the ends of the connecting pin, preferably at least 1.07 times greater, more preferably at least 1.09 times greater.

The diameter of the cross-section of the pin at the midpoint can for example be from 4 to 10 cm, the diameter of the cross-section of the ends can be from 2 cm to 7 cm, and the total length of the pin can be from 10 to 50 cm.

In one example, the diameter of the cross-section of the pin at the midpoint is 5.5 cm, the diameter of the cross-section of the ends is 5 cm, and the total length of the pin is 25 cm.

The number of holes and connecting pins to be inserted into the holes varies depending on the size of the containers to be connected.

In an exemplary embodiment where two 20' containers are connected, the containers comprise two holes distributed along the connection faces of the base panels of the two containers, and two pins are inserted into the holes during connection.

Further, the connecting pin may be telescopic.

In general, the frames of the first and second containers abut when they are connected.

Alternatively, the coupling arrangement might take the form of a spacer which is sandwiched between the first and second containers. Such a spacer might for example comprise a plank having holes along two sides to be connected to the first and second containers, said holes to receive pins and said pins to be received in corresponding holes in the first and second containers to connect and align the first and second containers. A plurality of such planks might be provided, for example four planks for bridging the gap on all four sides between the first and second containers. Not all of the planks may have holes/pins. In some embodiments, the pins could be formed integrally with the plank(s), in which case the plank(s) would not have holes.

In a further embodiment the first container and/or the second container can be standing on height adjustable feet fixed to an outer lower surface allowing height adjustment of the first and/or second container.

The first container may have one, two, three or four side panels/walls each arranged between two adjacent vertically extending profiles. The side panels may be removably attached to the vertically extending profiles. The side panels may be removably attached to the top panel and/or base panel. A part of one or more of the side panels may be removable, to form an opening for access into the first container.

The second container may have one, two, three or four side panels/walls each arranged between two adjacent vertically extending profiles. The side panels may be removably attached to the vertically extending profiles. The side panels may be removably attached to the top panel and/or base panel. A part of one or more of the side panels may be removable, to form an opening for access into the second container.

Connecting sides of the first and second containers may have corresponding openings that are in alignment when the first and second containers are connected together. In one embodiment, the aligned openings are provided by removing the side panels at the connection faces of the first and second containers.

In a further embodiment the container arrangement can comprises at least three containers removably connected adjacent to each other.

The present invention also relates to a method for providing a container arrangement by connecting and aligning a first container and a second container. The method comprises aligning the connection features of the first and second container and connecting and aligning the first container and a second container by interfacing the connection features with a coupling arrangement.

When the coupling arrangement is a connecting pin and the connection features are holes, the method may include inserting a first end of the connecting pin into the hole of the first container and thereafter moving the second container comprising the corresponding hole onto the other end of the connecting pin, creating a tight fit friction connection.

In one embodiment of the containers have the size and shape of a 20',40' and/or 45' intermodal container.

BRIEF DESCRIPTION OF THE DRAWINGS

The following drawings are appended to facilitate the understanding of the invention. The drawings show embodiments of the invention, which will now be described by way of example only, where:

FIG. 2(*b*) is a detailed view of a connecting pin;

FIG. 6(*b*) is a detailed view of the height adjustable foot shown in FIG. 6(*a*);

FIG. 9(*b*) is a detailed view of the circled area in FIG. 9(*a*) showing an intermediate element.

DETAILED DESCRIPTION OF THE INVENTION

Figure 1:
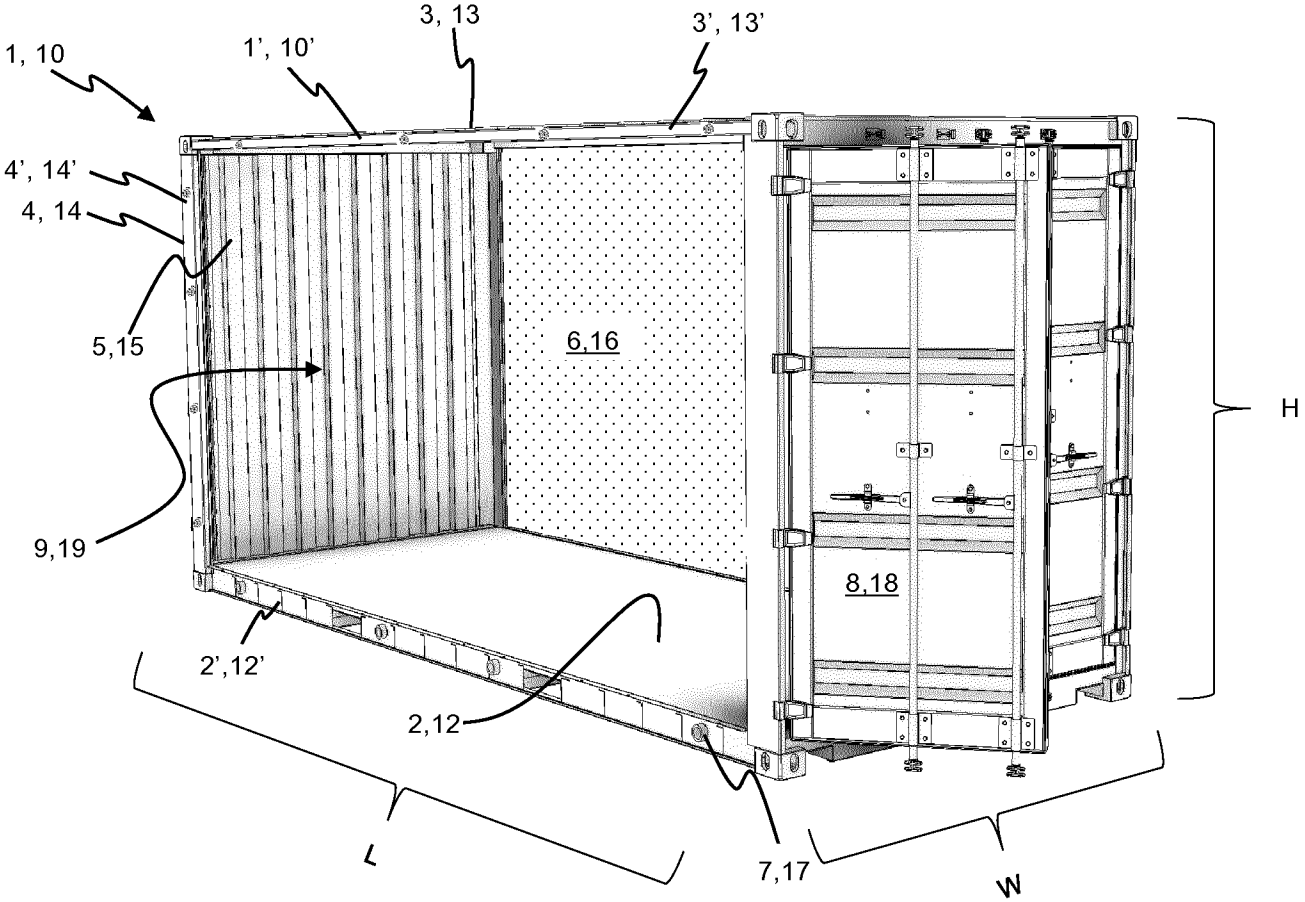
FIG. 1 is a perspective view of a container of a container arrangement according to the invention.

In the following, embodiments of the invention will be discussed in more detail with reference to the appended drawings. It should be understood, however, that the drawings are not intended to limit the invention to the subject-matter depicted in the drawings.

FIG. 1 illustrates a first container 1 or a second container 10.

The first container 1 has a substantially rectangular cuboid shaped first container frame 1'. The container frame shown in FIG. 1 comprises a base panel 2, a top panel 3 and four vertically extending profiles 4 extending from each corner of the base panel 2. The four vertically extending profiles 4 are connected to the corners of the top panel 3 such that the top panel 3 and the base panel 2 are aligned in a parallel relationship, directly on top of each other. Thus, the width W and the length L of the base and top panel 2, 3 are equal and separated by a height H by the vertically extending profiles 4 being of the same height H. Two adjacently arranged vertically extending profiles 4 form the edges of a vertical face. Thus, the substantially rectangular cuboid shaped first container frame 1' can be considered to comprise two short end vertical faces and two long end vertical faces.

The first short end vertical face in FIG. 1 comprises a short end side panel 5, while the other short end vertical face comprises a door arrangement 8 which when closed acts as a short end side panel. Further, the figure shows a long end side panel 6 arranged at the first long end vertical face, while the other long end side vertical face is open/empty, thereby creating an opening 9. This open vertical face is to be connected with another container having a corresponding opening.

An automated storage and retrieval system may be arranged inside the first container frame 1'.

FIG. 1 may also illustrate a second container 10 having a substantially rectangular cuboid shaped second container frame 10' comprising a base panel 12, a top panel 13 and four vertically extending profiles 14 extending from each corner of the base panel 12. The four vertically extending profiles 14 are connected to the corners of the top panel 13 such that the top panel 13 and the base panel 12 are aligned in a parallel relationship directly on top of each other. Thus, the width W and the length L of the base and top panel 12, 13 are equal and separated by a height H by the vertically extending profiles 14 being of the same height H. Two adjacently arranged vertically extending profiles 14 form the edges of a vertical face. Thus, the substantially rectangular cuboid shaped second container frame 10' can be considered to comprises two short end vertical faces and two long end vertical faces.

The first short end vertical face in FIG. 1 is a short end side panel 15, while the other short end vertical face comprises a door arrangement 18 which when closed acts as a short end side panel. Further, the figure shows a long end side panel 16 arranged at the first long end vertical face, while the other long end side vertical face is open/empty thereby creating an opening 19. This open vertical face is to be connected with another container having a corresponding opening.

An automated storage and retrieval system may be arranged inside the second container frame 10'.

It should however be understood that FIG. 1 does not illustrate a first and a second container to be connected as illustrated, since that would require one of the containers to be mirrored in order for the first and second container to have connection faces comprising corresponding openings 9, 19. If the first and second container to be connected comprise an automated storage and retrieval system, the corresponding openings 9, 19 will provide for interconnection between the rail systems of the two storage and retrieval systems.

When a first container 1 is connected to a second container 10, the vertical face of the first container 1 having the opening 9 will be connected to the vertical face of the second container 10 having the corresponding opening 19. In other words, the first and second container 1, 10 have interfaces comprising the corresponding openings 9,19.

The base panel 2, 12 of the first and second container 1, 10 has a cuboidal form. Thus, the base panel 2, 12 has a length and a width, defining an upper surface and lower surface of the base panel 2, 12, and a depth (i.e. a vertical extent 2',12') that extends between the upper surface and the lower surface of the base panel 2.

Similarly, the top panel 3, 13 of the first and second container 1, 10 has a cuboidal form. Thus, the top panel 3, 13 has a length and a width, defining an upper surface and lower surface of the top panel 3, 13, and a depth (i.e. a vertical extent 3',13') that extends between the upper surface and the lower surface of the top panel 3, 13.

Further, the each vertically extending profile 4, 14 of the first and second container 1, 10 has a cuboidal form. Thus, the extending profiles 4, 14 have a length and a width, defining an upper surface and a lower surface of each vertically extending profile 4, 14, and a depth (i.e. a vertical extent 4',14') that extends between the upper surface and the lower surface of each vertically extending profile 4, 14.

The vertical extents 2',12' of the base panel of the first and second containers, and/or the vertical extents of the top panel 3',13' of the first and second containers, and/or the vertical extents 4',14' of the vertically extending profiles of the first and second containers which interface with the coupling arrangement correspond to the claimed «at least a portion of the first container frame at the first connection face and at least a portion of the second container frame at the second connection face» which «comprise connection features configured to interface with the coupling arrangement to connect and align the first and second containers».

When a first and a second container 1, 10 are connected, at least one of the vertical extents 2',3',4' of the first container 1 facing the second container 10 and correspondingly, at least one of the vertical extents 12',13',14' of the second container 10 facing the first container 1 will have connected interfaces. A coupling arrangement will be arranged such that at least one of the vertical extents of the base panel 2, 12, top panel 3, 13 and vertically extending profiles 4, 14 of the connected interfaces will be connected in a tight fit friction connection.

The coupling arrangement may comprise a plurality of pins to be inserted into connection features, e.g. holes 7, 17 arranged within at least one of the base panel, 2, 12, top panel 3, 13 and vertically extending profiles 4, 14 of the first and second container 1, 10 to be connected. Examples of such configuration will be explained in detail in FIGS. 2 to 5.

Figure 2:
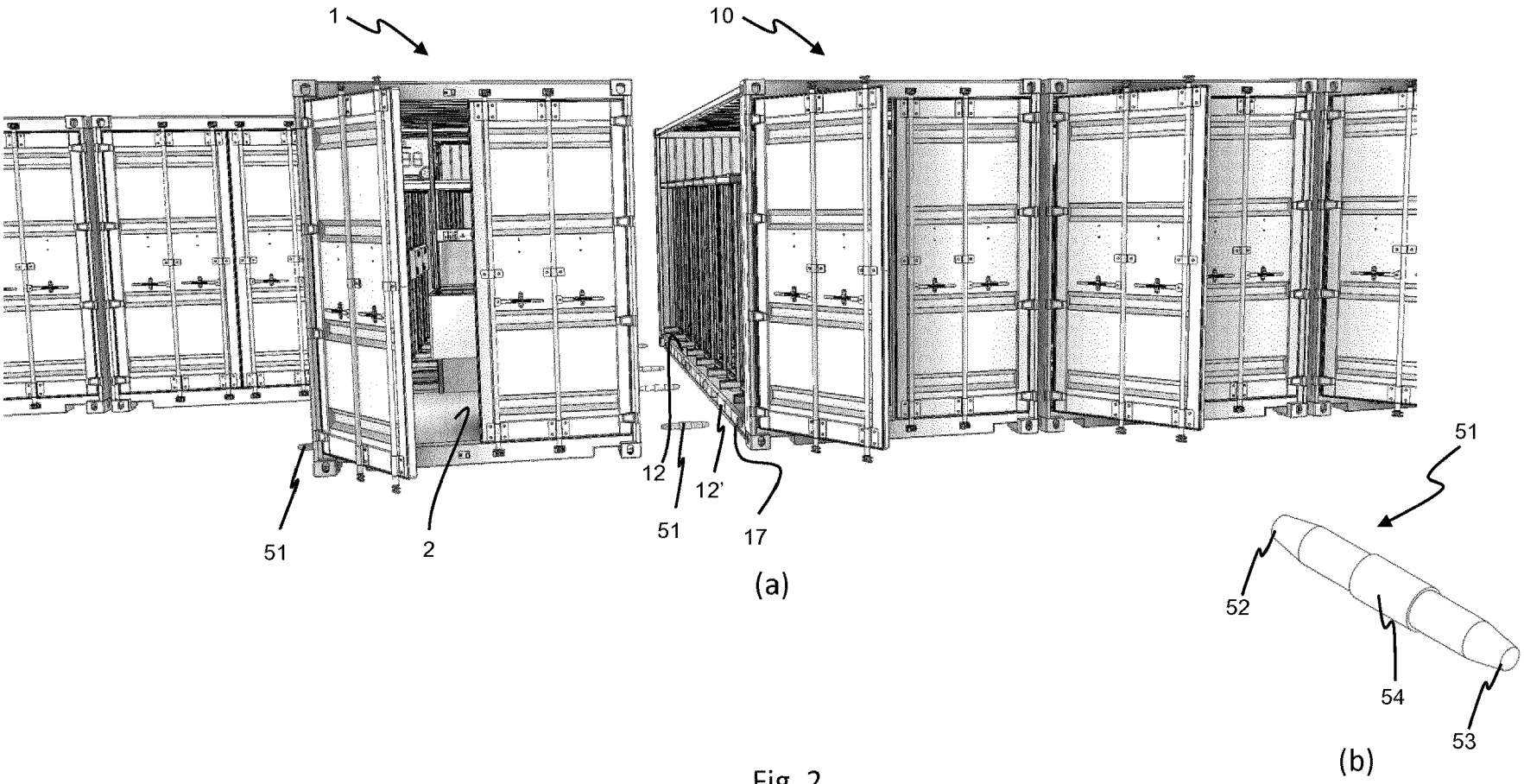
FIG. 2(*a*) is a perspective view of a container arrangement where two containers are to be connected.

FIG. 2(*a*) illustrates the first and the second containers 1, 10 before being connected. The coupling arrangement comprises a plurality of connecting pins 51 to be inserted into holes 7, 17 within the base panel 2, 12, top panel 3, 13 and/or vertically extending profiles 4, 14 of the first and second container 1, 10. In FIG. 2 the holes 7 of the first container are arranged on the vertical extent 2' of the base panel 2, extending into the base panel 2 below the opening 9 (see FIG. 3). The holes 17 of the second container 10 are arranged on the vertical extent 12' of the base panel 12, extending into the base panel 12 below the opening 19.

The holes 7, 17 can have many shapes for allowing a pin to connect in a tight fit friction connection. However, it is preferred that the shape of the holes 7, 17 are for example funnel-shaped for guiding the connecting pins 51 into the holes 7, 17. The pin 51 with a corresponding shape to the holes 7, 17 can be configured to match the smallest diameter of the holes 7, 17.

In general, the holes 7, 17 and connecting pins 51 will have corresponding shapes, such that when the connecting pin 51 is received within a hole 7, 17, a tight fit frictional connection is formed.

If the container arrangement only comprises the first and the second container 1, 10, the long end vertical faces of the two containers that are not connected to any container will comprise a long end side panel for protecting the inside of the container arrangement. As shown in the figure, the first short end vertical face of the first and second container 1, 10 comprises a short end side panel 5, 15, while the other short end vertical face comprises a door arrangement 8, 18.

However, if the container arrangement comprises three or more containers in a side-by-side arrangement, the container that is situated between two containers will have openings at both long end vertical faces if connected between these vertical faces.

Further, it be understood that the containers can alternatively or additionally be connected along their short end vertical faces as long as the vertical faces to be connected have corresponding openings.

The outer perimeter/border/vertical faces of the container arrangement should comprise side panels or door arrangements.

FIG. 2(*b*) illustrates a detailed view of a connecting pin 51 having a smaller cross-section at its ends 52, 53 than at its midpoint 54, such that the cross-section of the connecting pin 51 expands from the ends 52, 53 towards the midpoint 54 of the connecting pin 51.

The dimeter of the cross-section at the midpoint 54 of the connecting pin 51 may be at least 1.05 times greater than the diameter at the cross-section at the ends 52, 53.

The connecting pin 51 can be telescopic allowing easy removal of a container. Thus, when a container is to be removed from the container arrangement, the connecting pin 51 can retract into a retracted state wherein the connecting pin 51 does not protrude outside the framework of the container that it has been inserted in to. Thus, it may retract to occupy the hole 7, 17 of the container that is not removed from the container arrangement.

Figure 3:
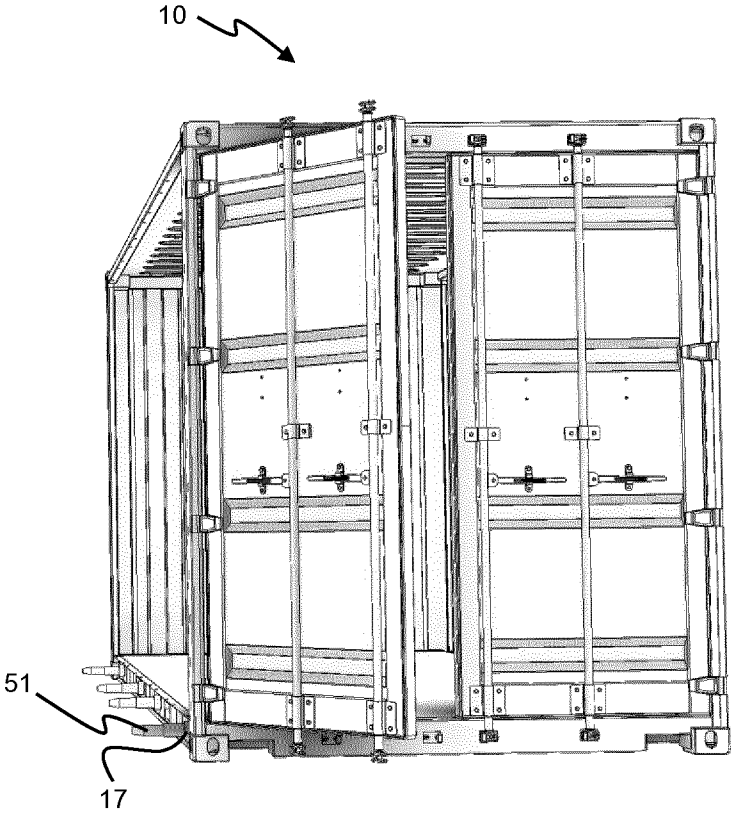
FIG. 3, FIG. 4 and FIG. 5 are perspective views of a container arrangement where two containers are to be connected.
Figure 3:
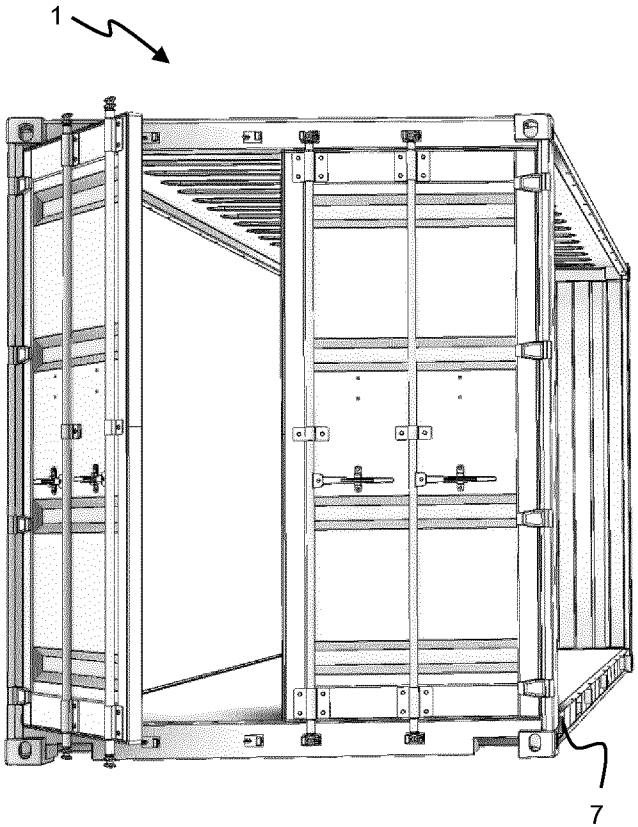
Figure 4:
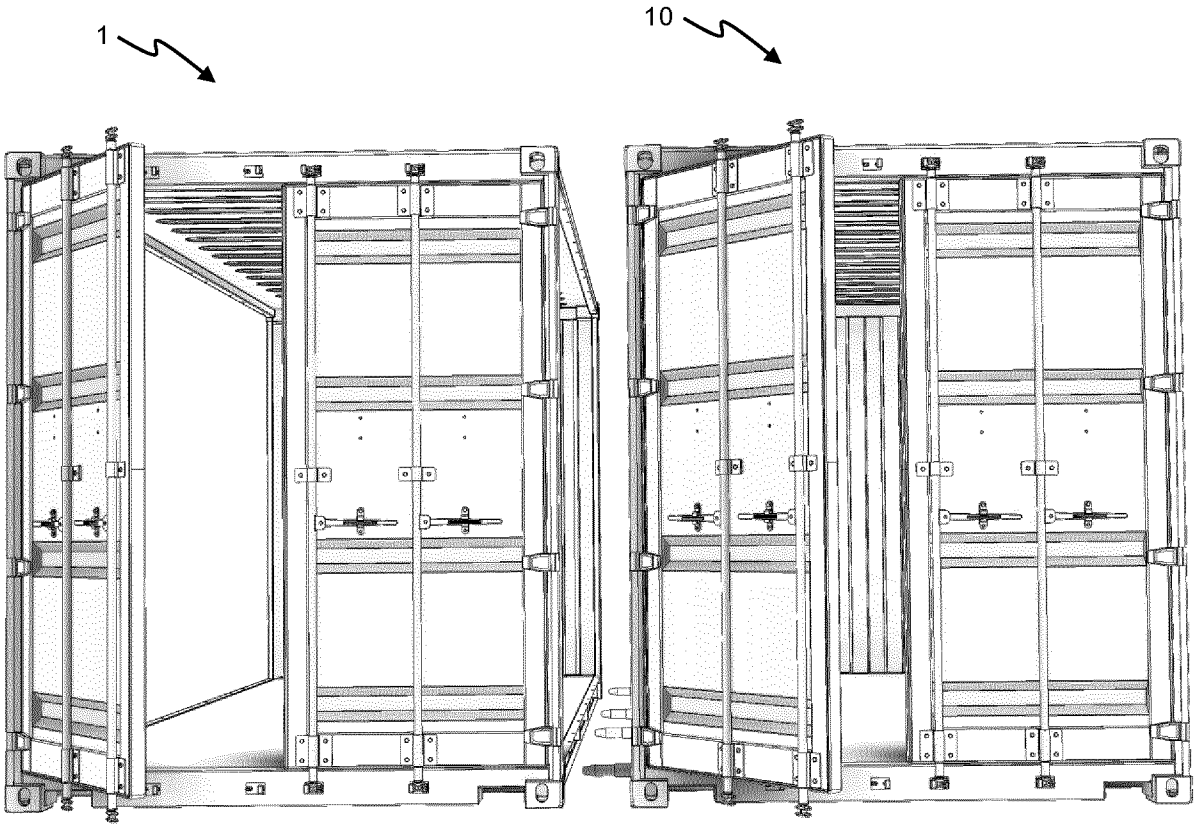
Figure 5:
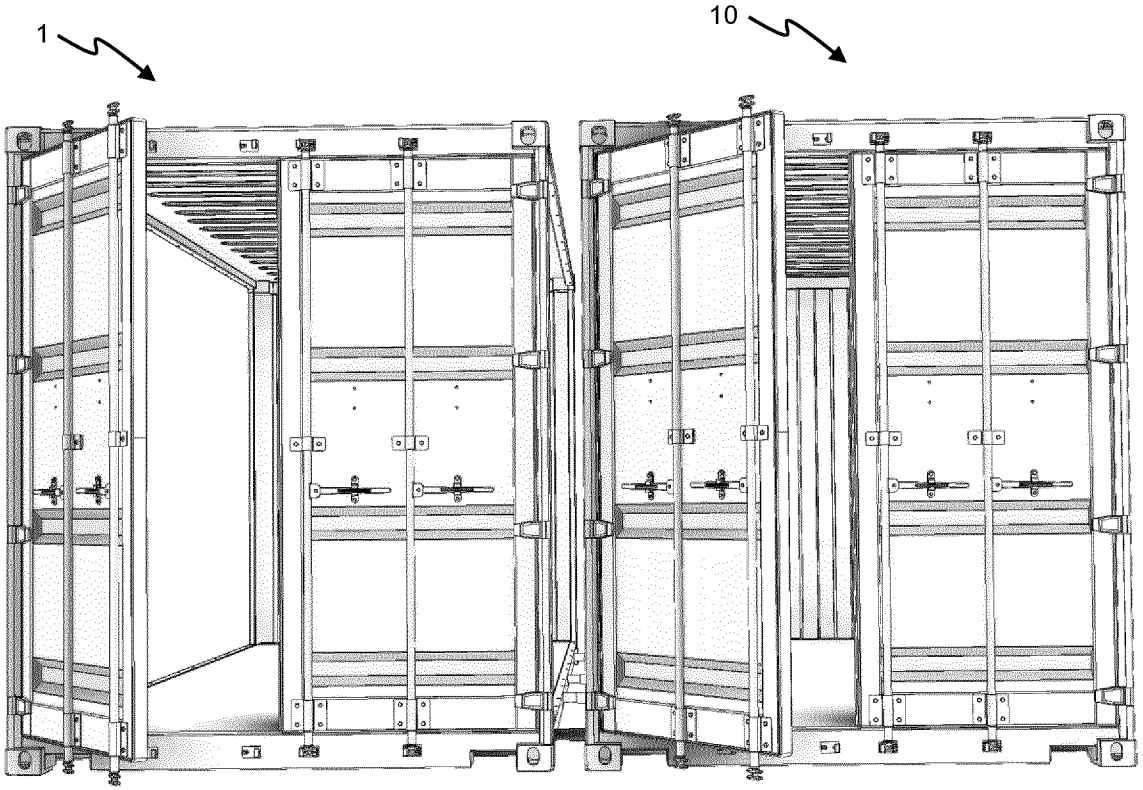

FIGS. 3 to 5 illustrate the connection of a first container 1 with a second container 10.

When connecting the two containers, the first end 52 of the connecting pin 51 is inserted into the hole 17 of the second container 10 followed by moving the first container 1 comprising the corresponding holes 7 onto the other end 53 of the inserted connecting pin 51 until the two adjacent vertical faces of each container meet (not shown).

In the exemplary embodiment the container arrangement comprises a first container 1 and a second container 10 to be connected, each having the size of a 20' container as shown in Table 1. Four holes 7 are arranged in the vertical extent 2' of the base panel 2, 12 (distributed along its horizontal extent) of the first container 1 and four corresponding holes 17 are arranged at the vertical extent 12' of the base panel 12 (distributed along its horizontal extent) of the second container 10. The holes 7 of the first container face the holes 17 of the second container 10 during connection, thus one hole 7 of the first container 1 and the corresponding facing hole 17 of the second container 10 are connected by the connecting pin 51. The holes 7, 17 should be distributed along the horizontal length of the base panel.

It should be obvious to a person skilled in the art that the number and position of the holes including connecting pins will vary depending on the size and weight of the containers to be connected.

Figure 6:
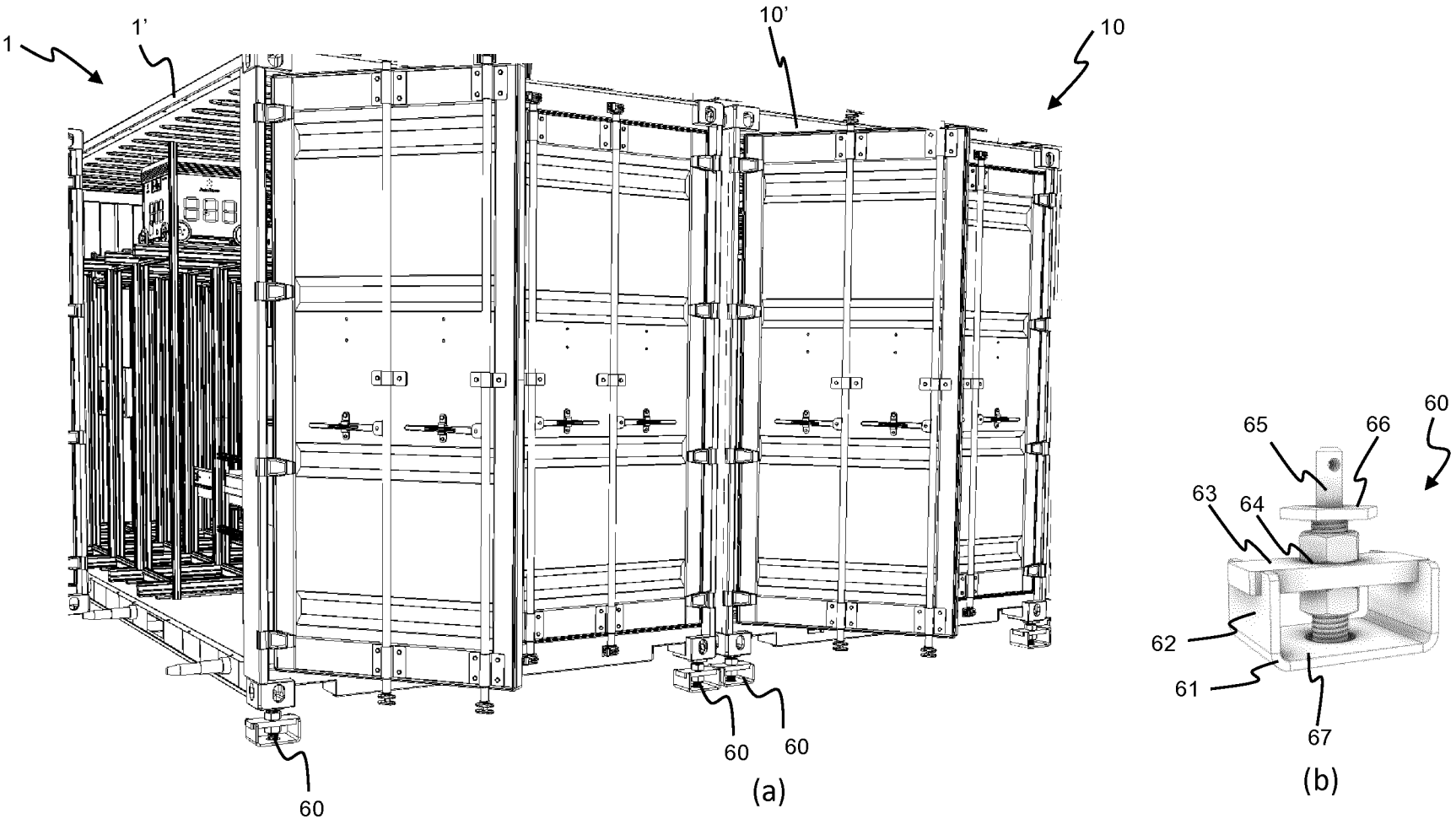
FIG. 6(*a*) is a perspective view of a container arrangement of two containers standing on height adjustable feet.

FIG. 6(*a*) illustrates a first and second container 1, 10 arranged on height adjustable feet 60. The feet 60 are placed below the lower surface of the base panel 2,12 of the first and second container 1, 10 at each corner thereof allowing leveling of the first container 1 and the second container 10 and providing substantially flush lower surfaces between base panels 2, 12 of the first and second containers 1, 10.

FIG. 6(*b*) shows a detailed view of the exemplary height adjustable foot 60 shown in FIG. 6(*a*). The foot 60 comprises a bracket 61 comprising lower base 67 for standing/resting on the ground. The base 67 of the bracket comprises two side walls 62 vertically extending from opposite sides of the base 67 and being interconnected by a bridge 63 comprising a hole 64 in its center. A bar 65 is arranged inside the hole 64 of the bridge 63 and is displaceable in the vertical the Z-direction, restricting movements in the horizontal X and Y-directions. The bar 65 has a resting plate 66 arranged above the bridge 63 allowing the container to rest thereon. By this arrangement the bar 65 can be displaced by loosening and fastening fixtures (for example nuts) which are attached in this case to a threaded bar 65 of both sides of the bridge 63 of the bracket 61. As shown the bar 65 may pass through a hole arranged at the center of the base 67 of the bracket 61. Further, the bar 65 may be fixed to the container at its upper end, for example by welding or by some other connecting means.

When displacing the bar 65, the part of the container arranged on the foot 60 will be displaced accordingly allowing fine adjustment Z-direction of the mobile container.

When arranging a plurality of containers 1, 10 in a side-by-side arrangement and placing height adjustable feet 60 under every corner of the base plate of each container 1, 10, the mobile containers 1, 10 can all be arranged such the outer surfaces of the base panels of the two mobile containers connecting to each other are flush with one another during connection and after connection.

Whilst the height adjustable feet have been described as being placed under every corner of the base plate of each mobile container, they may additionally be provided at other locations around the bottom perimeter of the base plate of each mobile container.

Figure 7:
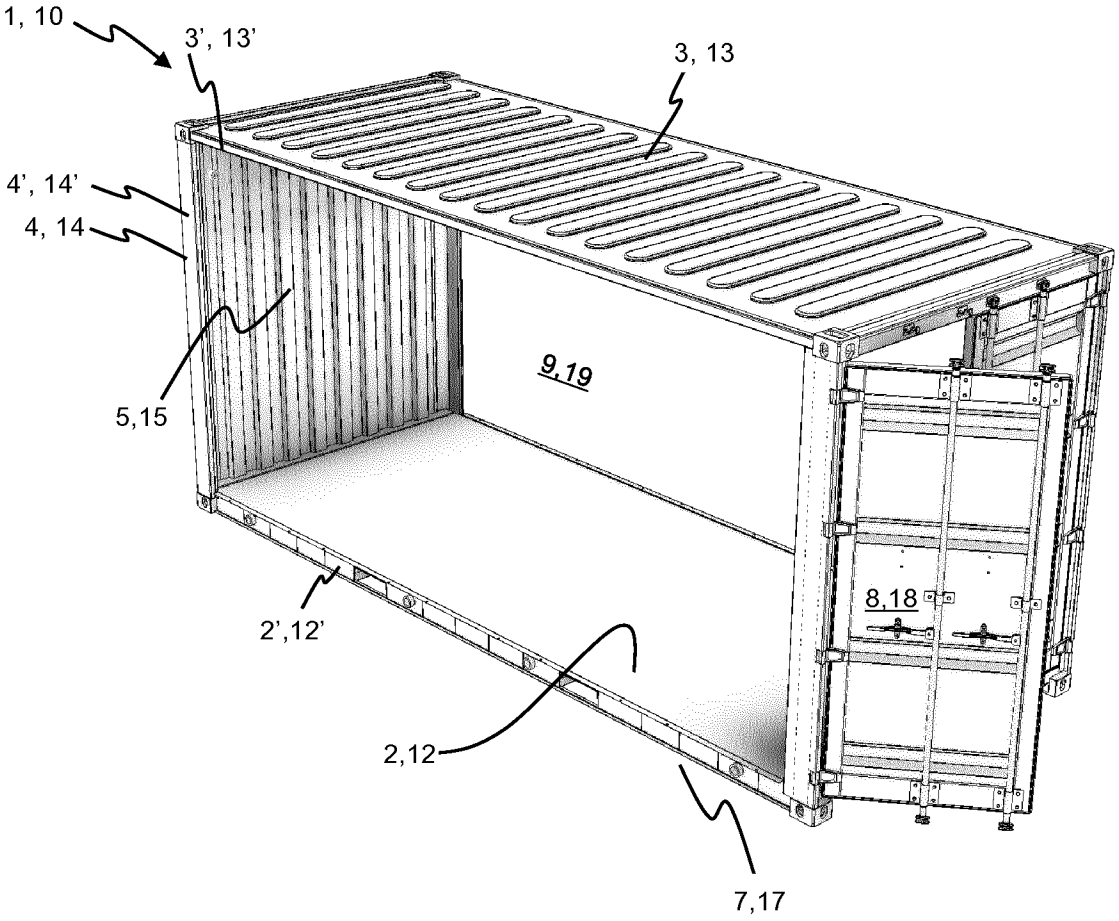
FIG. 7 is a perspective view of a container having two open vertical faces.

FIG. 7 illustrates a first or second container 1, 10 similar to one shown in FIG. 1, where both of the long end vertical faces have an opening, thus allowing each of the vertical faces to be connected to other containers.

Figure 8:
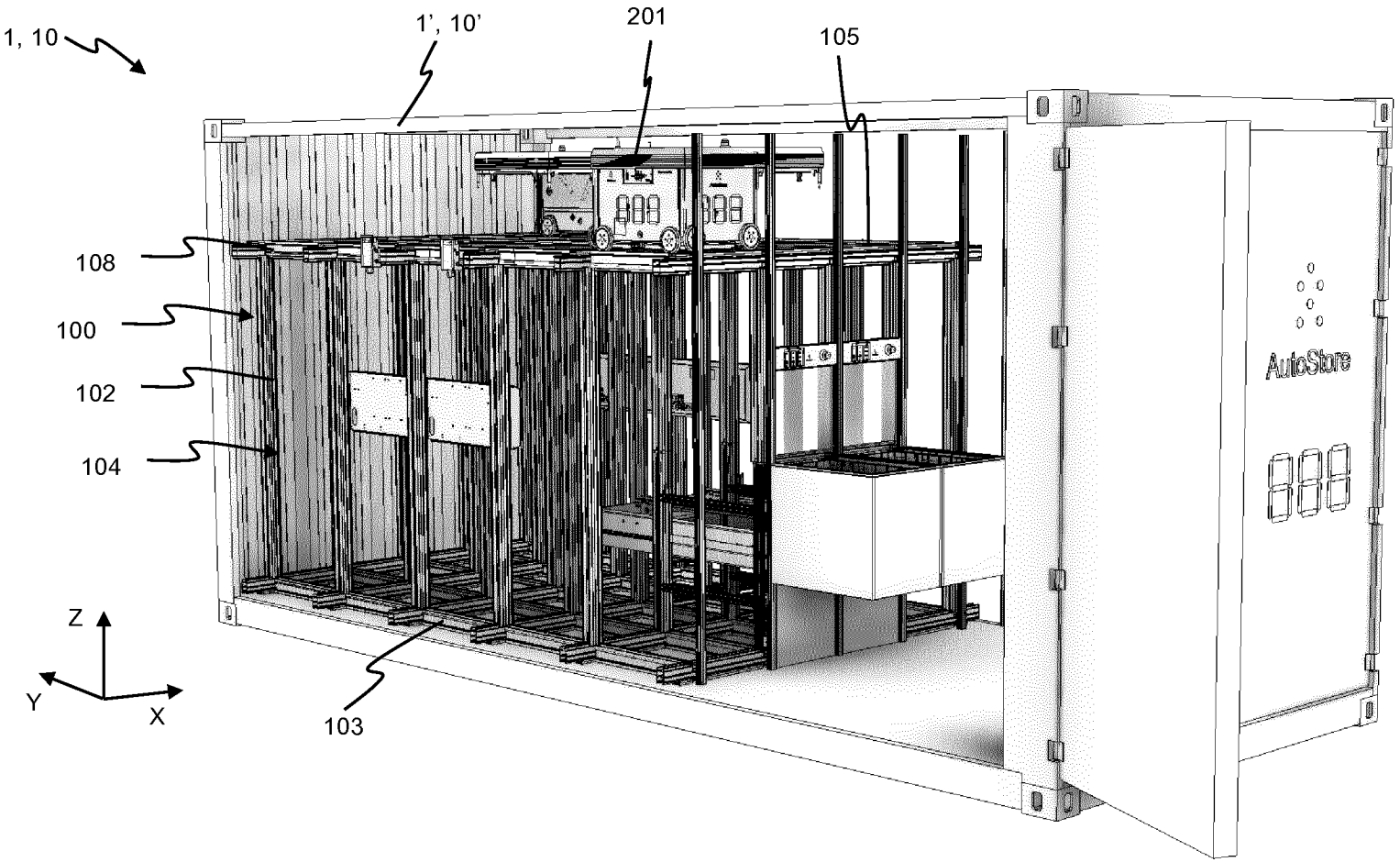
FIG. 8 is a perspective view of a container having an automated storage and retrieval system inside the container.

FIG. 8 illustrates an example of a first or a second container 1, 10 having an automated storage and retrieval system within the container frame 1',10'.

A typical automated storage and retrieval system has a framework structure 100 comprising a number of upright members/vertical members 102 and a number of horizontal members 103 which can be supported by the vertical members 102 (not shown) and/or be arranged at the base of the framework structure 100 as shown. When the horizontal members 103 are arranged at the base of the framework structure 100, they may be arranged in a grid pattern supporting the vertical members 102. The members 102, 103 may typically be made of metal, e.g. extruded aluminum profiles.

The framework structure 100 further defines a storage grid structure 104 comprising storage columns 105 arranged in rows. In these storage columns 105, storage bins (not shown) are stacked one on top of another to from a stack of storage bins. The storage grid structure 104 guards against horizontal movement of the stacks and guides vertical movement of the bins, but normally does not otherwise support the storage bins when they are stacked.

Further, the automated storage and retrieval system comprises a rail system 108 arranged in a grid pattern across the top of the storage grid structure 104, on which rail system 108 a bin handling vehicle 201 is operated to raise storage bins from, and lower storage bins into, the storage columns 105, and to transport the storage bins above the storage columns 105. It should be understood that the automated storage and retrieval system may comprise a plurality of vehicles, even if this is not shown in FIG. 8. The rail system 108 comprises a first set of parallel rails arranged to guide movement of the bin handling vehicle 201 in a first direction X across the top of the framework structure 100, and a second set of parallel rails arranged perpendicular to the first set of rails to guide movement of the bin handling vehicle 201 in a second direction Y which is perpendicular to the first direction X.

In this way, the rail system 108 allows the bin handling vehicle 201 to move horizontally above the storage columns 105, i.e. in a plane which is parallel to the horizontal X-Y plane.

Thus, in order to connect a first and second container 1,10, each having an automated storage and retrieval system inside the frame 1',10', the opening of both the first and second container 1, 10 should be at least the size of the maximum cross section of a bin handling vehicle 201 carrying a storage bin (taken in a vertical plane perpendicular to the axis of movement of the bin handling vehicle 201 when moving through the opening, said vertical plane being parallel to the plane of the side panel in which the opening is formed) moving on the rail system.

Moreover, the opening should of course be located accordingly, i.e. positioned such that the bin handling vehicle 201 can move from the rail system 108 of one mobile container on to the rail system 108 of another mobile container. That is, the opening may have a vertical extent extending at least from just below the horizontal plane of the rail system, upwards at least to the height of the bin handling vehicle carrying a bin on the rails. The opening may extend vertically below, and/or vertically above such an opening.

Of course, the opening may be larger than the size of the maximum cross section of a bin handling vehicle carrying a bin moving on the rail system. For example, the opening may have a height that is at least the height of a bin handling vehicle carrying a bin moving on the rail system, but the width may extend across substantially the entire side at which the two containers are to be connected. The opening may be created by removal of a panel, in which case the opening is of course substantially the size of the removed panel.

Figure 9:
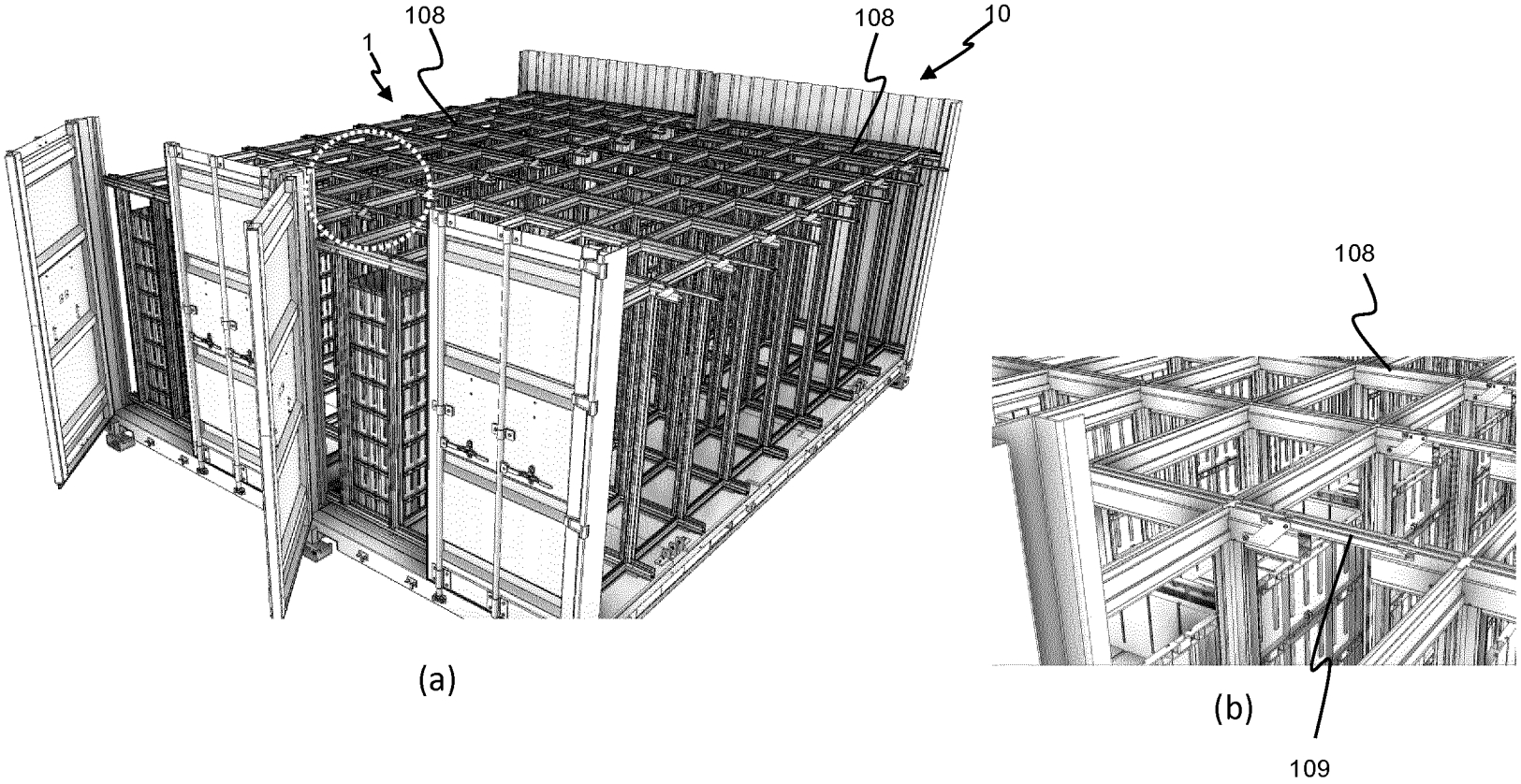
FIG. 9(*a*) is an open top view of the container arrangement shown in FIG. 6(*a*).

FIG. 9(*a*) is an open top view of the container arrangement shown in FIG. 6(*a*), wherein both the first and the second container 1, 10 have an automated storage and retrieval system arranged inside the corresponding first and second container frame 1',10'. Each automated storage and retrieval system comprises storage bins. As can be seen, the openings of the connected vertical faces of the first and second container 1, 10 allow the first and second automated storage and retrieval system to be interconnected such that the bin handling vehicles can move between the rail system 108 of the grid structure of the first container 1 and the rail system 108 of the grid structure of the second container 10.

If there is a gap between the rail systems 108 of the first and second container 1, 10, an intermediate element 109, shown in detail in FIG. 9(*b*), can be connected to the rail systems 108 allowing the bin handling vehicles to move thereon.

REFERENCE NUMERALS

1 First container
1' First container frame
2 Base panel of first container
2' At least a portion of connection face/vertical extent of base panel of first container
3 Top panel of first container
3' At least a portion of connection face/vertical extent of top panel of first container
4 Vertically extending profile of first container
4' At least a portion of connection face/vertical extent of vertically extending profile of first container
5 Short end side panel/side panel of first container
6 Long end side panel/side panel of first container
7 Connection features/hole/funnel shaped hole of first container
8 Door arrangement
9 Opening of the first container
10 Second container
10' Second container frame
12 Base panel of second container
12' At least a portion of connection face/Vertical extent of base panel of second container
13 Top panel of second container
13' At least a portion of connection face/vertical extent of top panel of second container
14 Vertically extending profile of second container
14' At least a portion of connection face/Vertical extent of vertically extending profile of second container
15 Short end side panel/side panel of second container
16 Long end side panel/side panel of second container
17 Connection features/hole/funnel shaped hole of second container
18 Door arrangement
19 Opening of the second container
51 Coupling arrangement/connecting pin
52 First end of connecting pin
53 Second end of connecting pin
54 Midpoint/centre of connecting pin
60 Height adjustable foot
61 Bracket
62 Side wall of bracket
63 Bridge
64 Hole in bridge
65 Bar
66 Resting plate
67 Base of bracket
100 Framework structure
102 Vertical members
103 Horizontal members
104 Storage grid structure
105 Storage columns
108 Rail system
109 Intermediate element
201 Bin handling vehicle
X First direction
Y Second direction
Z Third direction

The invention claimed is:

1. A container arrangement comprising:

a first container for storing a first automated storage and retrieval system, wherein the first container comprises a first container frame defining a first connection face;

a second container for storing a second automated storage and retrieval system, wherein the second container comprises a second container frame defining a second connection face; and a coupling arrangement for connecting and aligning the first and second container side-by-side, with the first connection face of the first container aligned with the second connection face of the second container, wherein at least a portion of the first container frame at the first connection face and at least a portion of the second container frame at the second connection face comprise connection features comprising holes configured to interface with the coupling arrangement comprising a connecting pin, wherein the connecting pin is received within the holes to align and connect the first and second containers forming a tight-fit friction connection, and wherein the first container and/or the second container comprise height adjustable feet fixed to an outer lower surface, allowing height adjustment of the first and/or second container.

2. The arrangement according to claim 1, wherein the coupling arrangement is configured to releasably connect the first and the second containers, such that the first and second containers can be separated from each other when needed.

3. The arrangement according to claim 1, wherein the first container frame has a substantially rectangular cuboid shape and comprises a first base panel, and the second container frame has a substantially rectangular cuboid shape and comprises a second base panel, and wherein the connection features are located along the first base panel at the first connection face, and along the second base panel at the second connection face.

4. The arrangement according to claim 1, wherein the first container frame has a substantially rectangular cuboid shape and comprises a first top panel, and the second container frame has a substantially rectangular cuboid shape and comprises a second top panel, and wherein the connection features are located along the first top panel at the first connection face, and along the second top panel at the second connection face.

5. The arrangement according to claim 1, wherein the first container frame has a substantially rectangular cuboid shape and comprises a first plurality of vertically extending profiles, and the second container frame has a substantially rectangular cuboid shape and comprises a second plurality of vertically extending profiles, and wherein the connection features are located along two of the first plurality of vertically extending profiles at the first connection face, and along two of the second plurality of vertically extending profiles at the second connection face.

6. The arrangement according to claim 1, wherein the holes have a funnel shape and the connecting pin is configured to match at least the smallest diameter of the funnel shaped holes creating the tight fit friction connection.

7. The arrangement according to claim 1, wherein the connecting pin has a smaller cross-section at its ends than at its midpoint, such that the cross-section of the connecting pin expands from the ends towards the midpoint of the connecting pin.

8. The arrangement according to claim 7, wherein the diameter of the cross-section at the midpoint is at least 1.05 times greater than the diameter of the cross-section at the ends of the connecting pin.

9. The arrangement according to claim 1, wherein the connecting pin is telescopic.

10. The arrangement according to claim 1, wherein the first container comprises two side panels each arranged between two adjacent vertically extending profiles.

11. The arrangement according to claim 1, wherein the second container comprises two side panels each arranged between two adjacent vertically extending profiles.

12. The arrangement according to claim 1, wherein the arrangement comprises at least three containers removably connected adjacent to each other.

* * * * *